United States Patent [19]

Lisiecki

[11] Patent Number: 4,789,066

[45] Date of Patent: Dec. 6, 1988

[54] CONTAINER WITH PROTECTIVE SEAL AND TEAR STRIP

[75] Inventor: Robert E. Lisiecki, Orchard Lake, Mich.

[73] Assignee: Ex-Cell-O Corporation, Walled Lake, Mich.

[21] Appl. No.: 555,247

[22] Filed: Nov. 25, 1983

[51] Int. Cl.[4] ..... B65D 5/70

[52] U.S. Cl. ..... 206/611; 206/628; 206/629; 229/125.42; 229/160.2

[58] Field of Search ..... 229/7 R, 17 R, 17 G, 229/37 R, 48 T, 125.42, 160.2; 206/611, 628, 629, 622

[56] References Cited

U.S. PATENT DOCUMENTS

| | | | |
|---|---|---|---|
| 2,434,756 | 1/1948 | Brooks | 229/17 R |
| 3,101,879 | 8/1963 | Meyer-Jagenberg | 229/7 R |
| 3,197,112 | 7/1965 | Meyer-Jagenberg | 229/37 R |
| 3,220,599 | 11/1965 | Fried et al. | 206/628 |
| 3,294,310 | 12/1966 | Miller et al. | 229/48 T |
| 3,899,079 | 8/1975 | Seiter | 206/611 |
| 3,998,378 | 12/1976 | Vetten | 229/17 R |
| 4,113,103 | 9/1978 | Carlsson | 206/611 |
| 4,126,263 | 11/1978 | Martensson | 229/17 R |
| 4,192,446 | 3/1980 | Naito | 229/17 G |
| 4,197,949 | 4/1980 | Carlsson | 229/17 R |

FOREIGN PATENT DOCUMENTS

| | | | |
|---|---|---|---|
| 613932 | 2/1961 | Canada | 229/17 R |
| 898609 | 6/1962 | United Kingdom | 229/17 G |
| 1203772 | 9/1970 | United Kingdom | 229/17 R |

*Primary Examiner*—Stephen Marcus
*Assistant Examiner*—Gary E. Elkins
*Attorney, Agent, or Firm*—John P. Moran

[57] ABSTRACT

A flat top container and the blank for constructing same, including a fin seal which is folded flat, and wherein spaced lines of perforations adapted to provide a tear strip are formed in one outer end closure panel, overlying a separate protective seal strip, formed of aluminum foil or other suitable material, sealed to the inside surface of the panel. The side seam flap which interconnects adjacent side panels has a tab extending from the free edge thereof, and is folded in half to eliminate raw edges inside and to cause the tab to extend beyond the edge of the top closure, to serve as a pouring lip once the tear strip is lifted and the protective seal strip is broken.

3 Claims, 3 Drawing Sheets

CONTAINER WITH PROTECTIVE SEAL AND TEAR STRIP

TECHNICAL FIELD

This invention relates generally to thermoplastic coated paperboard containers and, more particularly, to a blank and a container including a folded top end closure of an improved construction.

BACKGROUND ART

Containers for beverages such as milk, cream, other dairy products, juices, and the like are conventionally constructed from thermoplastic coated paperboard. One well known type of these containers includes a top end closure with a folded gable roof having a vertically projecting seal at the roof ridge for sealing the container and providing a readily available pouring spout when the contents of the container are to be dispensed. Such an arrangement is shown and described in Egleston et al U.S. Pat. No. 3,270,940. Other containers have included gable top end closures which have been flattened into flat top configurations. As an example of such arrangement, see Skjelby U.S. Pat. No. 4,206,867. Still other containers which are known to eliminate internal raw edges consist of a so-called "fin seal" type top closure configuration, such as shown and described in Auslegeschrift No. 1,586,458.

Coated paperboard blanks for constructing such a container are made on converting machines similar to those disclosed by Monroe et al. U.S. Pat. No. 2,682,208 and Earp U.S. Pat. No. 3,731,600. After construction, the blanks are processed by forming, filling and sealing machines, such as those disclosed by Monroe et al. U.S. Pat. No. 3,303,761, Allen U.S. Pat. No. 3,918,236, Egleston U.S. Pat. No. 3,398,659 or Young U.S. Pat. No. 4,193,833, to produce the formed, filled and sealed containers of the Egleston et al and Skjelby types referred to above, both of which open into a "pitcher pour" type spout. The U.S. Pat. No. 1,586,458 fin seal top does not open into a suitable pouring spout but, rather, requires the cutting or tearing off of a corner in order to provide a pouring opening.

While these containers have been generally satisfactory, it is desirable to incorporate features whereby raw edges are eliminated on the inside of the container and an additional inner seal is provided in conjunction with a tear strip to provide a pouring spout structure and to help insure the sterile integrity of the container.

DISCLOSURE OF THE INVENTION

Accordingly, a general object of the invention is to provide a blank for forming a liquid-carrying container including improved top closure means for attaining the above desirable characteristics.

Another object of the invention is to provide an improved sterile pouring spout arrangement for a liquid-carrying container.

A further object of the invention is to provide an improved container including a tear strip and a separate seal embodying a sterile pouring spout structure without internal raw edges.

A still further object of the invention is to provide a top closure arrangement for a paperboard container, wherein the triangular front and back closure gussets are outfolded, rather than infolded, and an aluminum foil seal strip is sealed onto the inside edge portion of one of the roof side panels, beneath a pair of spaced perforated lines which serve to provide a tear strip adjacent the seal strip. The latter may then be broken through to release the contents of the container.

Other objects and advantages of the invention will become more apparent when reference is made to the following description and the accompany drawings.

BEST MODE OF CARRYING OUT THE INVENTION

Figure 1:
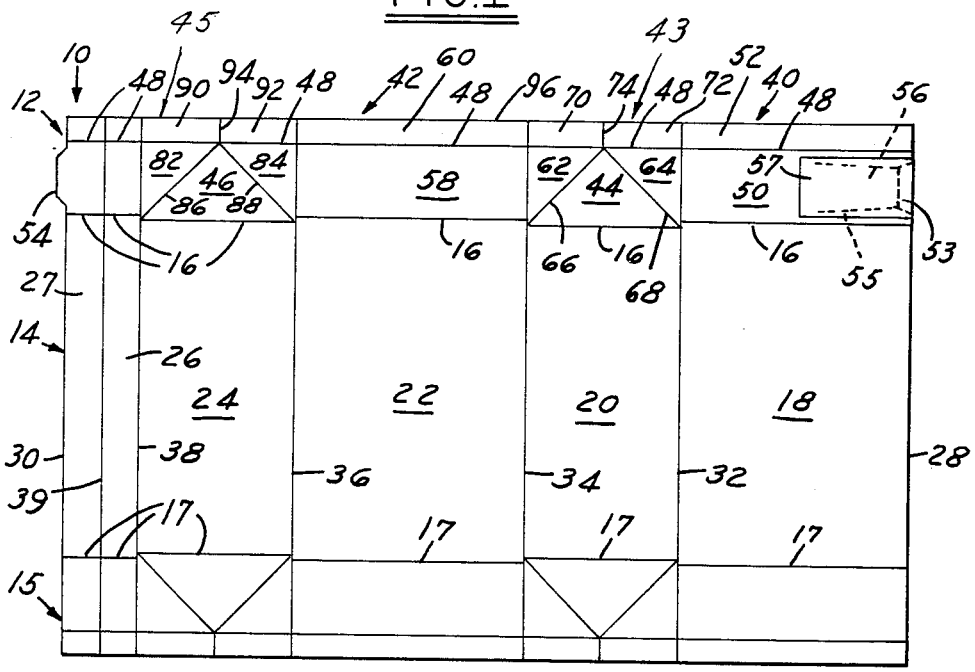
FIG. 1 is a layout view of the inside surface of a coated paperboard container blank used to construct a container having a top end closure with a top seal and pouring spout arrangement in accordance with the present invention.

Referring now to the drawings in greater detail, FIG. 1 illustrates the inside surface of a container blank 10 formed in accordance with the principles of the present invention. The container blank 10 is generally divided into three sections including a top end closure 12, a body portion 14, and a flat bottom end closure 15. The latter may be similar to that shown and described in either Egleston et al. U.S. Pat. No. 3,120,335, or Lisiecki U.S. Pat. No. 4,341,340, or it may be substantially the same as the basic top end closure 12, as shown in FIG. 1. More specifically, a staggered lower top horizontal score line 16 extends transversely across the container blank 10 and separates the top end closure 12 and the body portion 14. Similarly, a bottom staggered horizontal score line 17 extends transversely across the container blank 10 and separates the bottom end closure 15 and the body portion 14. The body portion 14 comprises a plurality of integrally connected body panels, namely, a side panel 18, a back panel 20, a side panel 22 and a front panel 24, and dual side seam flaps or narrow fifth and sixth panels 26 and 27 formed adjacent the panel 24. The side panels 18 and 22 are wider than the front and back panels 20 and 24, as shown. If desired, the panels 18, 20, 22 and 24 could be substantially the same width, producing a square cross section container. The container blank 10 is defined on its longitudinal sides by its edges 28 and 30. The body panels 18, 20, 22 and 24, and the side seam flaps 26 and 27, are defined by vertical score lines 32, 34, 36, 38 and 39.

The top end closure 12 comprises cover panels 40 and 42. The panels 40 and 42 are connected integrally to the upper ends of the body panel members 18 and 22, respectively. Two alternately disposed gusset panels 43 and 45, including triangular panels 44 and 46 are connected integrally to the body panels 20 and 24, respectively. A straight upper top horizontal score line 48 extends transversely from the blank edge 28 to the blank edge 30, substantially parallel to the horizontal score line 16.

The cover panel 40 is divided basically into two portions by the horizontal score line 48. A lower closure panel 50 is defined by the edge 28 and the score line 32. An upper closure panel portion 52 of the panel 40 serves as a sealing panel, as will be explained. When a notch 53 is formed at the edge 28 portion of the panel 50, there results a tab or pouring lip 54 formed on the edge 30 portion of each narrow side seam panel 27. Diverging perforated lines 55 are formed in the panel 50, extending from the edge of the notch 53, adapted to provide a tear strip 56. A seal strip 57 of aluminum foil or other suitable material is secured to the right half (FIG. 1) portion of the lower closure panel 50 on top of the perforated lines 55, with the outer edge thereof shown aligned with the edge 28 of the blank 10. If desired, the outer edge of the seal strip 57 may be shaped to coincide with either the edge of the notch 53, or the edge of the pouring lip 54.

The cover panel 42 is also divided into two parts by the score line 48. The inner part of the roof panel 42 comprises a lower closure panel 58 which is defined by the horizontal score lines 16 and 48 and the vertical score lines 34 and 36. The panel 42 includes an upper closure panel 60 which is integral with the closure panel 58, and it is separated therefrom by the score line 48.

The triangular panel 44 is connected to a pair of inner roof or fold-back panels 62 and 64 by diagonal score lines 66 and 68, respectively. The fold-back panels 62 and 64 connect the triangular panel 44 to the closure panels 58 and 50, respectively. A pair of outfold lips 70 and 72 are integrally connected to the foldback panels 62 and 64, respectively, and they are defined by a portion of the horizontal score line 48, the vertical score lines 34 and 32, and an intermediate vertical score line 74. The triangular base angles of the panel 44 are normally formed so as to be equal.

The triangular panel 46 is integrally connected to a pair of inner roof or fold-back panels 82 and 84 by diagonal score lines 86 and 88, respectively. The fold-back panel 82 integrally connects the triangular closure panel 46 to the narrow fifth panel 26. A pair of outfold lips 90 and 92 are connected to the fold-back panels 82 and 84, respectively, and they are defined at their lower ends by the score line 48 and at their outer edges by the score lines 38 and 36, respectively. The outfold lips 90 and 92 are separated from each other by a vertical scoreline 94. The base angles of the triangular panel 46 are normally formed so as to be equal. The upper outer edge 96 of the blank 10 is a straight edge.

Figure 2:
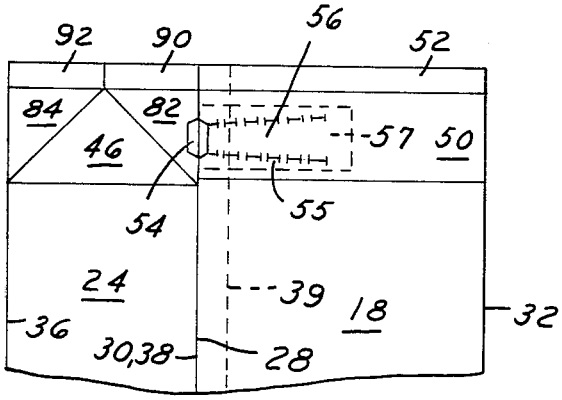
FIG. 2 is a fragmentary layout view of the outside surface of a container structure after it is side seamed from the container blank illustrated in FIG. 1.

The container blank 10 illustrated in FIG. 1 is first formed into a side seamed blank by rotating the narrow sixth panel 27 about the score line 39, i.e., into the paper in FIG. 1, and sealing the outside surface of panel 27 to the outside surface of panel 26, and then rotating the body panel 24 and the sealed panels 26 and 27 as a unit about the vertical score line 36, and having the inside surfaces of the body panel 24 and the narrow side seam panel 26 come into contact with the inside surface of the body panel 22. The body panel 18 is then rotated about the vertical score line 32 to bring its inside surface into contact with the inside surfaces of the body panel 20 and the side seam panel 27. The various members of the top end closure 12 and the bottom end closure 15 will make similar movements. The container blank 10 is then sealed where the inside area of the body panel 18 comes into contact with the inside surface of the side seam panel 27, as shown in FIG. 2.

Figure 3:
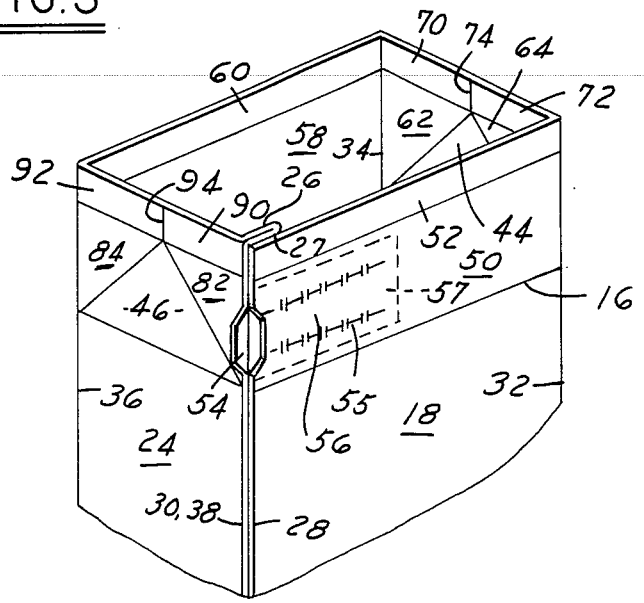
FIG. 3 is a fragmentary perspective view showing the side seamed container blank illustrated in FIG. 2 in an open ended top end view prior to the closing of the top closure structure of the present invention.

After the side seam blank is opened up into a squared condition (FIG. 3), the bottom end closure 15 is formed in a conventional manner, and a product, such as milk or juice, is inserted in the container. Thereafter, the various parts of the top end closure 12 are folded about the various score lines in the following manner so as to form the top end structure. The triangular panel 46 is moved around the horizontal score line 16 over the end of the filler container outwardly from its center. At the same time, the triangular panel 44 is moved outwardly from the middle of the filler container around the horizontal score line 16. In the process, the inside surfaces of the outfold lips 90 and 92 and the outfold lips 70 and 72 will be rotated towards each other around the respective vertical score lines 94 and 74. The respective inside surfaces of the upper closure panel portions 52 and 60 contact each other.

The sealing of the last mentioned elements of the top closure 12 is accomplished by conventional means, such as a sonic or high frequency vibration sealing means, such a seal providing a liquid tight seal. The sealing of these various top end closure elements may also be accomplished by other means, such as gas heat, if desired.

Thereafter the sealed upper closure panels 52 and 60 are urged toward the lower closure panel 58 about the score line 48, to bring the upper panel portion 60 into contact with the lower panel portion 58. Simultaneously, the outfold lips 70 and 92 are urged into contact with the foldback panels 62 and 84, respectively. There results a flattened configuration with a first set of panel portions 46, 82, 84, 90 and 92 extending outwardly from the score line 16 at the upper end of the front body panel 24, and a second set of panel portions 44, 62, 64, 70 and 72 extending outwardly from the score line 16 at the upper end of the back body panel 20.

Figure 4:
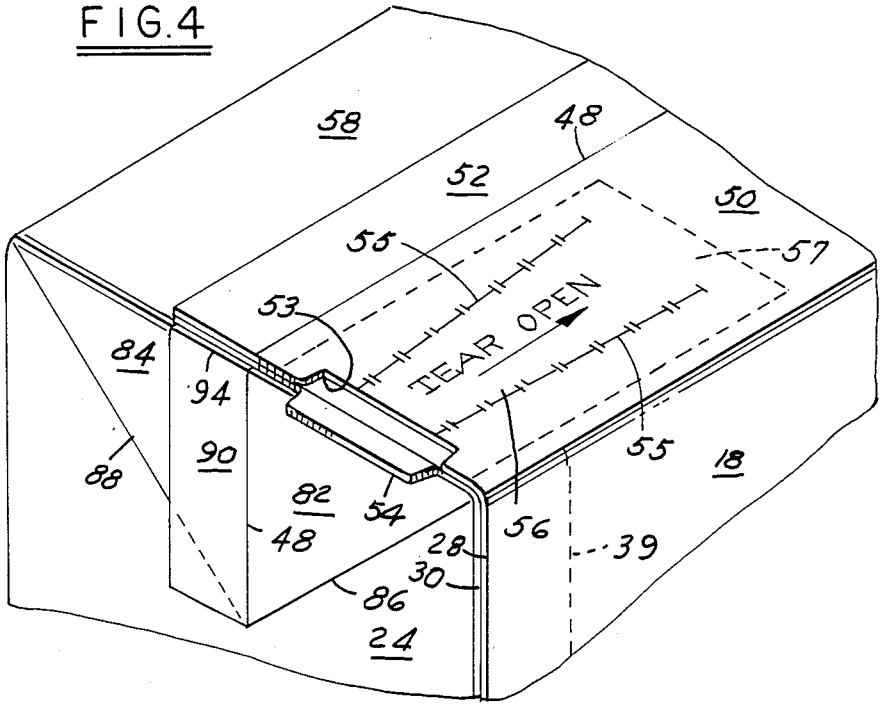
FIG. 4 is an enlarged fragmentary perspective view showing the container evolved from the side seamed blank of FIG. 2 in a closed condition.

As a last sealing operation, the first set of panel portions is heated and bent downwardly into sealing contact with the body panel 24, and the second set heated and bent downwardly into sealing contact with the body panel 20, as shown in FIG. 4, wherein the tab or pouring lip 54 is shown to extend laterally from beneath the foil strip 57.

Figure 5:
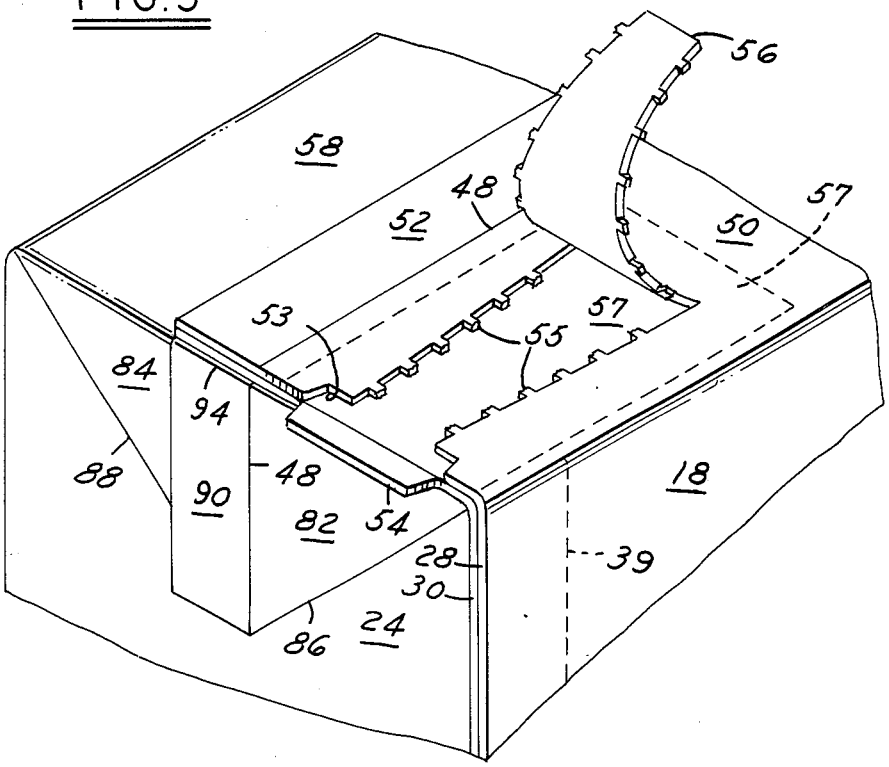
FIG. 5 is a fragmentary perspective view showing the container with the pouring spout in an intermediate step of the opening process.

The opening process consists of manually peeling back the tear strip 56 portion of the closure panel 50 which lies between the diverging perforated lines 55, as shown in FIG. 5, revealing the underlying foil strip 57. The latter may then be broken through to provide an opening (not shown) in through which a drinking straw may be inserted, or out through which the liquid contents may be poured over the pouring lip 54.

INDUSTRIAL APPLICABILITY

It should be apparent that the invention provides improved means for eliminating raw edges along the inside side surface of the container, and for assuring that the sterile integrity of the container top closure is maintained until opened, while providing means for readily and easily opening the container.

While but one embodiment of the invention has been shown and described, other modifications thereof are possible.

The embodiments of the invention in which an exclusive property or privilege is claimed are defined as follows:

1. A blank for forming a liquid carrying paperboard carton, said blank comprising first, second, third and fourth side panels and a side seam flap integrally connected to the outermost edge of said fourth side panel and having a score line formed along the full length of the centerline thereof; an end closure arrangement including a triangular panel connected to the end of each of said second and fourth side panels by a first score line and defined by diagonal score lines separating each triangular panel from a pair of foldout panels and second score lines separating each foldout panel from an outfold lip; a first rectangular panel connected to adjacent foldout panels by score lines and the end of said third side panel by said first score line and defined by a further score line across the width thereof and aligned with said second score lines; a second rectangular panel connected to one edge thereof to the adjacent foldout panel by a score line and to the end of the first side panel by said first horizontal score line and defined by a fourth horizontal score line across the width thereof and aligned with said second and third horizontal score lines, and having a notch formed in the free side edge thereof, spaced linear perforations formed in said second rectangular panel and extending from said notch to approximately the center of said panel to form a tear strip; a tab formed on the free edge of said side seam flap in alignment with said notch; and a separate non-perforated aluminum foil seal strip secured to said fourth end closure panel overlying said spaced linear perforations and said notch.

2. A flat end container comprising body panels including first, second, third and fourth side panels and a folded-in-half side seam flap interconnecting said first and fourth side panels; top end closure panels including oppositely disposed outfolded gusset panels respectively connected to the ends of said second and fourth side panels, and oppositely disposed first and second cover panels respectively connected to the ends of said first and third side panels, said first cover panel being connected at one edge thereof to said gusset panel of said second side panel, and said second cover panel being connected to each of said gusset panels, a notch formed in the free side edge of said first cover panel, spaced linear perforations formed in said first cover panel and extending from said notch past the innermost edge of said folded-in-half side seam flap to approximately the center of said first cover panel adapted to serve as a tear strip, an exposed tab formed on the free edge of said folded-in-half side seam flap in alignment with said notch and adapted to serve as a pouring lip, a separate, non-perforated protective seal strip secured to said first cover panel underlying said spaced linear perforations and said notch, and a fin seal formed and sealed along the outer edges of said cover panels and outfolded gusset panels and folded onto said second cover panel and said second and fourth side walls so as to provide ready access to said tear strip and said separate seal strip, said tear strip upon being peeled back permitting said separate seal strip to be broken through to provide an opening.

3. The container described in claim 2 wherein said separate seal strip is formed of aluminum foil.

* * * * *